US006860594B2

(12) United States Patent
Konno

(10) Patent No.: US 6,860,594 B2
(45) Date of Patent: Mar. 1, 2005

(54) IMAGE FORMING APPARATUS WITH IMPROVED JAM REMOVAL

(75) Inventor: Shinichi Konno, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/105,353

(22) Filed: Mar. 26, 2002

(65) Prior Publication Data

US 2002/0149661 A1 Oct. 17, 2002

(30) Foreign Application Priority Data

Apr. 11, 2001 (JP) ..... 2001-113206

(51) Int. Cl.[7] ..... B41J 2/01; B41J 29/38

(52) U.S. Cl. ..... 347/104; 347/14

(58) Field of Search ..... 399/16–21, 45, 399/82, 405, 327, 308, 344, 374; 400/74, 582, 642, 645.4; 347/218, 101, 103, 104, 105

(56) References Cited

U.S. PATENT DOCUMENTS 5,151,735 A * 9/1992 Yamashita et al. ..... 399/18
5,642,952 A * 7/1997 Tomatsu et al. ..... 400/624
6,026,272 A 2/2000 Kusaka et al. ..... 399/327
6,126,347 A * 10/2000 Sakaino et al. ..... 400/642

FOREIGN PATENT DOCUMENTS

JP 02001039576 A * 2/2001 ..... B65H/5/06

* cited by examiner

*Primary Examiner*—K. Figgins
*Assistant Examiner*—An H Do
(74) *Attorney, Agent, or Firm*—Fitzpatrick, Cella, Harper & Scinto

(57) ABSTRACT

An image forming apparatus according to the invention includes a first sheet-transfer unit for transferring a sheet, a second sheet-transfer unit for transferring downstream the sheet transferred from the first sheet-transfer unit, and a pivotable member for supporting either the first sheet-transfer unit or the second sheet-transfer unit. When an abnormal transfer state of a sheet is detected in the image forming apparatus, a controller controls driving at least one of the first sheet-transfer unit and the second sheet-transfer unit so as to move the sheet which stops spanning the first and second sheet-transfer units by a predetermined amount of movement, thereby forming a loop in the sheet.

10 Claims, 4 Drawing Sheets

IMAGE FORMING APPARATUS WITH IMPROVED JAM REMOVAL

BACKGROUND OF THE INVENTION

1. Field of the Invention

The present invention relates to image forming apparatuses, and, in particular, to an image forming apparatus for forming images on a sheet, such as a copying apparatus, a laser-beam printer, an ink-jet printer, a facsimile, or a multifunction apparatus provided with a plurality of the functions of these apparatuses.

2. Description of the Related Art

The image forming apparatuses for forming images on sheets are, for example, a copying apparatus, a laser-beam printer, an ink-jet printer, and a facsimile. The copying apparatus generally reads images from an original and forms the images on a sheet in accordance with read image data. Some of the more recent models of copying apparatus are provided with a communication function for receiving image data from the outside and forming images on sheets in accordance with the image data. The laser-beam printer or the ink-jet printer generally forms images on a sheet in accordance with the image data sent from an external device such as a computer. The facsimile is generally provided with functions to read images from an original and for communication such as sending read image data to the outside and receiving image data from the outside so as to form images on a sheet according to the received data. In recent years, multifunction apparatuses each having a plurality of the functions of a copying apparatus, a printer, and a facsimile have been known.

Hitherto, the above image forming apparatuses including, for example, electrophotographic image forming apparatuses have been each provided upstream of a photosensitive drum with a pair of registration rollers which is rotatably supported by the lateral side plates of the image forming apparatus. The pair of registration rollers stops a sheet at a nip part thereof, the sheet being transferred from a sheet holder such as a cassette which holds the sheets, corrects the direction of transfer of the sheet (compensate for an oblique direction), and moves the sheet by controlling timing such that the sheet is positioned at an imaging position of the rotating photosensitive drum.

The roller pressure of the pair of registration rollers (a pressing force applied to each other) must be set high (approximately 2 kg or more) for compensation for an oblique direction of the sheet. The pair of registration rollers must be provided coaxially with clutches such as electromagnetic clutches for on-off-switching of a driving force transmitted from a drive source because the movement of the sheet must be suspended for a moment. Therefore, the pair of registration rollers is generally mounted on the lateral side plates which have strength sufficiently large for receiving the high roller pressure and supporting the heavy clutches.

Since the pair of registration rollers must be mounted firmly, a transfer path, instead of the pair of registration rollers, downstream of the pair of registration rollers generally opens when sheets jammed between the pair of registration rollers and a transfer portion for transferring a toner to the sheet are handled. In this case, the jammed sheets are taken out by being transferred with the pair of registration rollers being manually rotated.

However, when the transfer path opens at a position toward the transfer portion for handling a jam occurring in the known image forming apparatus in a state in which a sheet is firmly nipped by the pair of registration rollers at the trailing end of the sheet, there is a risk in that the leading end of the sheet comes into contact with a part, such as a guide, of the image forming apparatus. In this case, when the toner image has been formed on and has not been fixed to a leading-end part of the sheet disposed in the transfer portion, there is the risk that the toner image will adhere to the part, such as a guide, of the image forming apparatus. The toner image on the part such as a guide may adhere to and stain the sheet when image forming is again performed after the jam handling is completed.

SUMMARY OF THE INVENTION

Accordingly, it is an object of the present invention to provide an image forming apparatus in which a toner image not fixed to a sheet which stops at a printer of the image forming apparatus does not adhere to other parts of the image forming apparatus.

To this end, according to an aspect of the present invention, an image forming apparatus comprises a first sheet-transfer unit for transferring a sheet; a second sheet-transfer unit for transferring in a downstream direction the sheet transferred from the first sheet-transfer unit; a sheet detector for detecting an abnormal transfer state of a sheet in the image forming means; a pivotable member for supporting at least one of the first sheet-transfer means and the second sheet-transfer means; and a controller for controlling driving at least one of the first sheet-transfer unit and the second sheet-transfer unit in accordance with the detection by the sheet detector to move the sheet by a predetermined amount so as to form a loop in the sheet which stops spanning the first sheet-transfer unit and the second sheet-transfer unit.

According to another aspect of the present invention, an image forming apparatus comprises a first sheet-transfer unit for transferring a sheet; a second sheet-transfer unit for transferring the sheet transferred from the first sheet-transfer unit to a downstream side; an image forming device for forming an image on the sheet transferred from the second sheet-transfer unit; a guide member for guiding the sheet transferred from the second sheet-transfer unit to the image forming device; an abnormal-transfer-state detector for detecting an abnormal transfer state of a sheet in the image forming apparatus; a sheet detector disposed in the vicinity of the image forming device, for detecting the sheet guided by said guide member; a pivotable member provided with the second sheet-transfer unit and the guide member, extending along a sheet-transfer path and being pivotable on a fulcrum disposed upstream of the sheet-transfer path in a direction away from the image forming device; and a controller for driving the first sheet-transfer unit in accordance with the detection by the abnormal-transfer-state detector, whereby the first sheet-transfer unit moves the sheet toward a downstream side by a predetermined amount of movement.

Further objects, features and advantages of the present invention will become apparent from the following description of the preferred embodiments with reference to the attached drawings.

DESCRIPTION OF THE PREFERRED EMBODIMENTS

Figure 2:
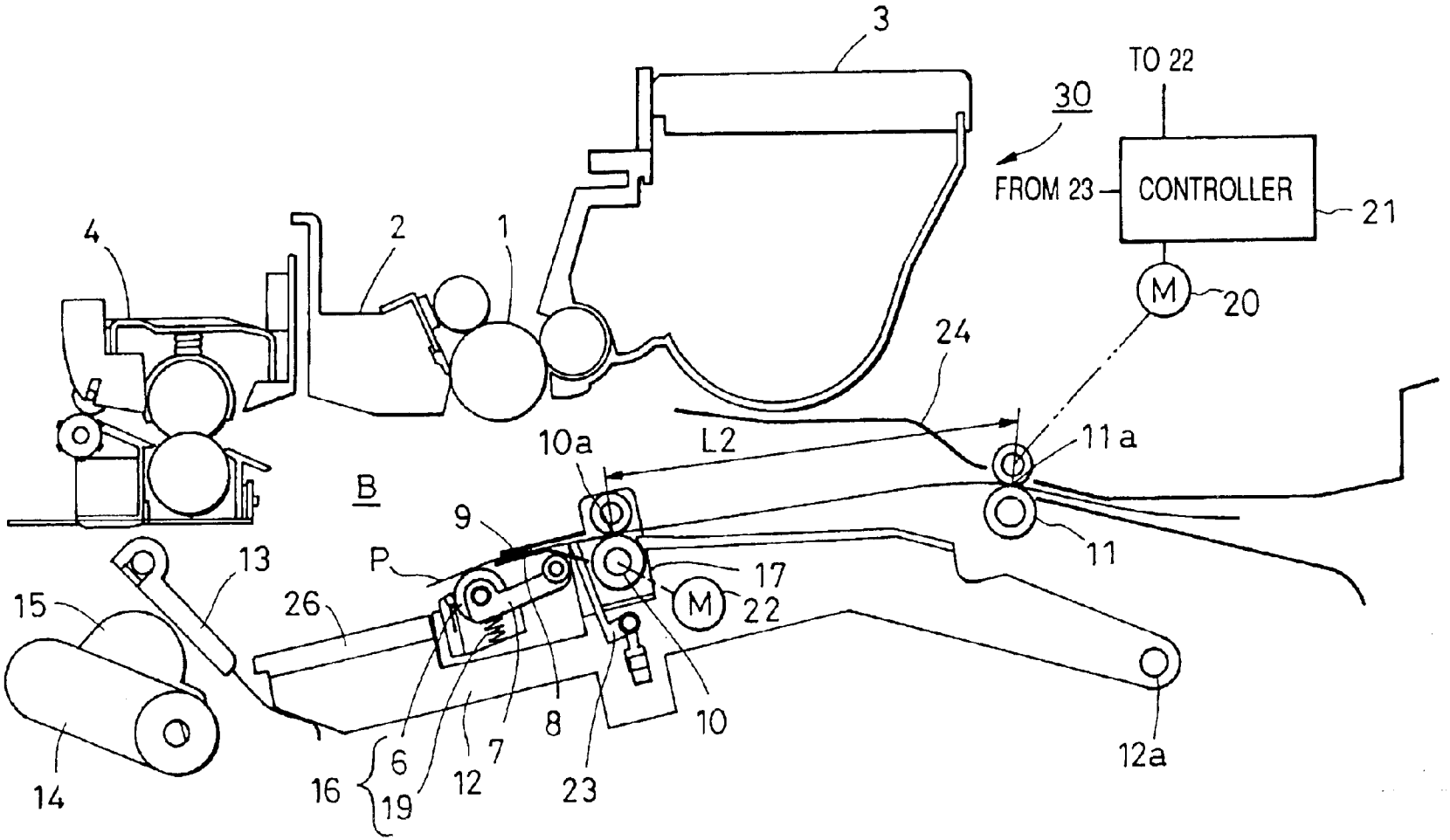
FIG. 2 is a sectional view of the laser-beam printer shown in FIG. 1 in which the laser-beam printer is configured for removal of a jammed sheet.
Figure 3:
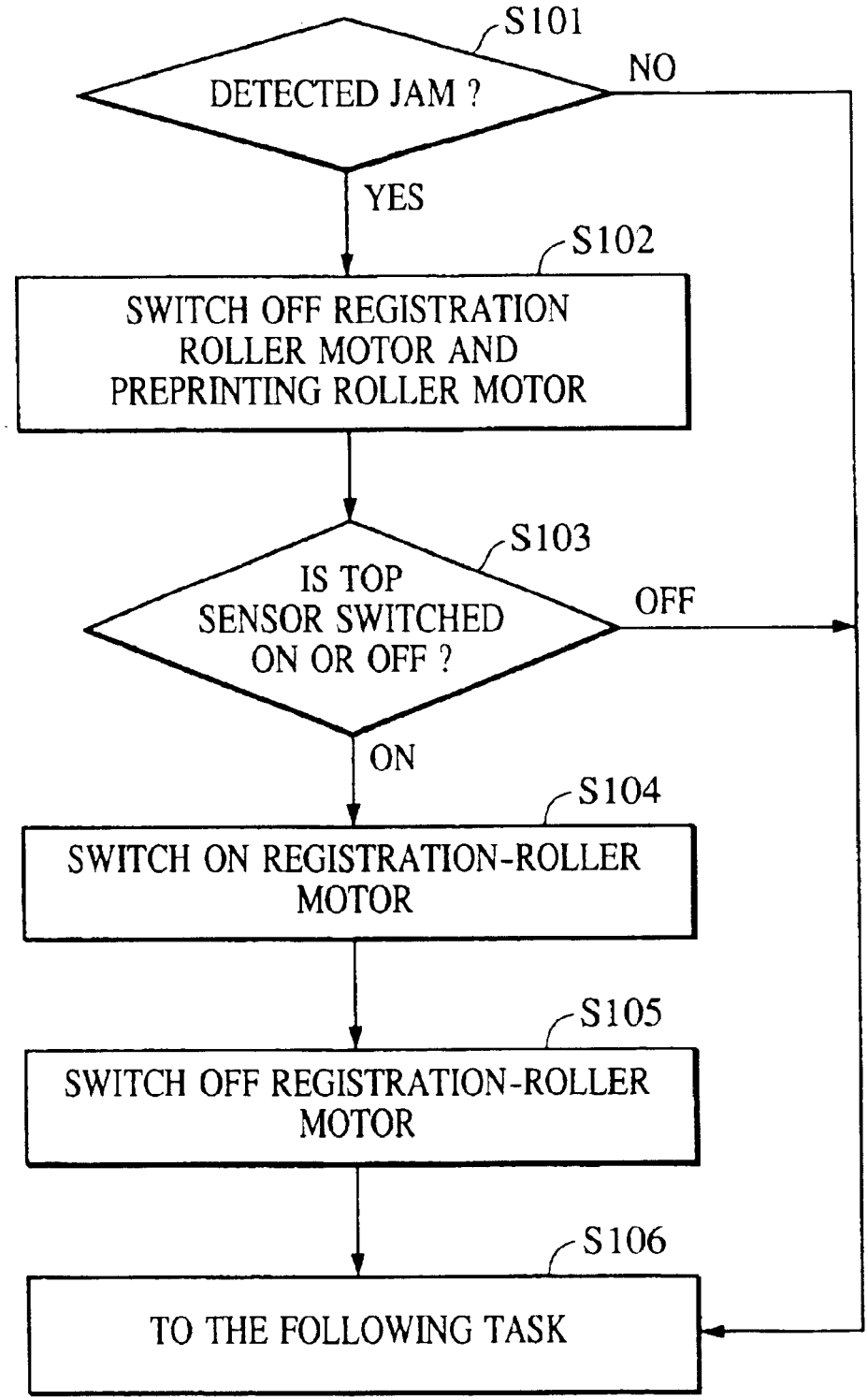
FIG. 3 is a flowchart showing an operation, when a sheet is jammed, of the laser-beam printer according to the present invention.

An image forming apparatus according to an embodiment of the present invention is described below with reference to FIGS. 1 to 3. In the following description, sizes, materials, shapes, relative positions, and the like are shown as examples, and the scope of the present invention is not limited to these examples unless otherwise particular description is provided.

Figure 1:
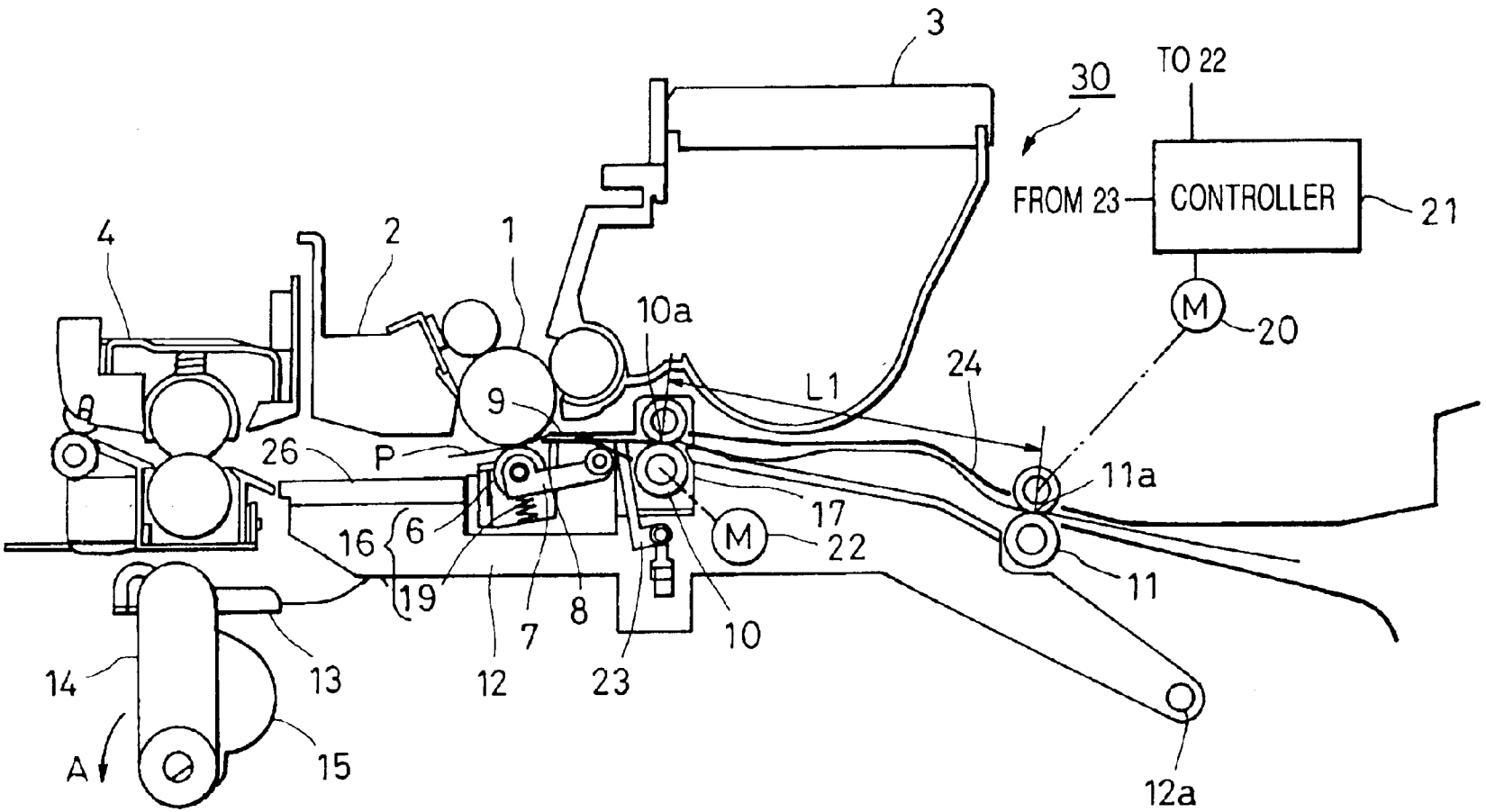
FIG. 1 is a sectional view of a laser-beam printer (image forming apparatus) according to an embodiment of the present invention.

FIG. 1 is a sectional view of a critical portion of the image forming apparatus. In FIG. 1, an image forming apparatus 30 is provided with a laser scanner (not shown) which applies a laser beam to a photosensitive drum (imaging device) 1 in accordance with image data either obtained from an external device or read from an original by an image-reading device, whereby a latent image is formed on the photosensitive drum 1. The image forming apparatus 30 is also provided with a developer 3 which develops the latent image to a toner image.

The image forming apparatus 30 is provided with a pair of registration rollers (serving as first sheet-transfer means) 11 and a pair of pre-printing rollers (serving as second sheet-transfer means) 10 in a transfer path for transfer of a sheet P from a sheet holder such as a cassette (not shown) to the photosensitive drum 1. The sheet P which is supplied one by one from the sheet holder is sent to a nip part between the photosensitive drum 1 and an image transfer roller 6 by the pair of registration rollers 11 and the pair of pre-printing rollers 10.

The image transfer roller 6 is supported by a printer arm 7 and is urged to the photosensitive drum 1 by a spring 19 at a predetermined pressure. The image transfer roller 6 and the spring 19 form an image transfer portion 16. A toner image is transfer-printed from the photosensitive drum 1 to the sheet P at the image transfer portion 16. Toner remaining on the photosensitive drum 1 after the toner image is transferred to the sheet P is removed from the photosensitive drum 1 by a cleaner 2, whereby the surface of the photosensitive drum 1 is cleaned for the subsequent image-formation.

A fixer 4 is provided downstream of the image transfer roller 6. A transfer guide 26 for guiding the sheet P with the toner image printed thereon to the fixer 4 is provided between the image transfer roller 6 and the fixer 4. The sheet P which has been conveyed to the fixer 4 has applied to it heat and pressure, whereby the toner image is fixed to the sheet P. The sheet P with the toner image fixed thereto is further conveyed and is discharged by discharging rollers (not shown) to the outside. The imaging operation performed by using the image forming device is thus completed.

The imaging operation of the image forming apparatus 30 is controlled by a controller 21. The controller 21 controls the rotation of a motor 20 for driving the pair of registration rollers 11, a motor 22 for driving the pair of pre-printing rollers 10, and another motor (not shown) for driving other rollers, in accordance with a determination by a top sensor (a sheet detector) 23 whether or not the sheet P has reached a position between the photosensitive drum 1 and the image transfer portion 16. The top sensor 23 functions to detect a jammed state of the sheet P in addition to detecting the leading end of the sheet P.

Although according to the present embodiment, the motor 20 for the pair of registration rollers 11 and the motor 22 for the pair of pre-printing rollers 10 are independently provided, one common motor for the pair of registration rollers 11 and the pair of pre-printing rollers 10 may be used. In this case, the pair of registration rollers 11 and the pair of pre-printing rollers 10 can be independently driven with clutches being individually disposed between the pairs of rollers and the common motor.

When a sheet jam occurs in the image forming apparatus 30 when transferring the sheet, a user must suspend the transfer of the sheets and remove the jammed sheets and the sheets staying at the sheet-transfer path. Therefore, a space from which the jammed sheets are removed must be provided between the photosensitive drum 1 and the fixer 4. In order to ensure the space, a transfer frame 12 holds a roller holder 17 for holding the pair of pre-printing rollers 10, the image transfer portion 16, and the transfer guide 26 when the distance between the photosensitive drum 1 and the fixer 4 is small. The transfer frame 12 extends along the sheet-transfer path and is supported pivotably on a fulcrum 12*a* which is positioned upstream of the sheet flow. The transfer frame 12 forms the sheet-transfer path together with a guide member 24 when the transfer frame 12 is in a closed state.

In FIG. 1, the transfer frame 12 is maintained in the closed state by a cam 15. When a user pivots a handle 14 in a direction A, the transfer frame 12 is released from the retention by the cam 15 and pivots downward, as shown in FIG. 2, thereby providing a space B from which the jammed sheet is removed.

The operation following detection of a jam is described below with reference to a flowchart shown in FIG. 3. The procedure of jam treatment varies according to the position of the jam.

A jam-treating task starts when the jam of the sheet P is detected (step S101) by one of a plurality of jam-detectors (not shown) provided in the sheet-transfer path.

When the jam-detector detects the jam, the controller 21 switches off the motor 20 for the pair of registration rollers 11 and the motor 22 for the pair of pre-printing rollers 10 (step S102), and thereby stops conveyance of sheet P. If sheet P is not positioned at the image transfer portion 16, the top sensor (serving as sheet-detecting means) 23 is switched off (step S103). In this case, the user rotates the handle in the direction A, whereby the transfer frame (pivoting member) 12 pivots on the fulcrum 12*a* and the space B for the jam treatment can be formed in the vicinity of the image transfer portion 16. Since the sheet P does not span the pair of registration rollers 11 and the pair of pre-printing rollers 10, the sheet P is not moved by the pivoting motion of the transfer frame 12 and the jam can be treated without additional movement of the rollers.

When the jammed sheet P is determined to be positioned at the image transfer roller 6 in step S103, the top sensor 23 is switched on. In this case, the controller 21 drives the motor 20 for the pair of registration rollers 11 by a predetermined amount of rotation and stops the same (steps S104 and 105), thereby slightly feeding the sheet P toward the downstream side by a distance L3 of, for example, 20 mm, whereby a sufficiently large loop of the sheet P is formed between the pair of registration rollers 11 and the pair of pre-printing rollers 10.

Although the sheet P nipped by the pair of registration rollers 11 and the pair of pre-printing rollers 10 at the trailing end and the leading end of the sheet P, respectively, is pulled by an amount corresponding to a distance (L2–L1) when the transfer frame 12 pivots in the jam-treating operation, the position of the leading end of the sheet P with respect to the image transfer roller 6 does not significantly vary because the distance L3 is set to be greater than the distance (L2–L1). Reference numeral L1 represents a distance between a nip part 11*a* of the pair of registration rollers 11 and a nip part 10*a* of the pair of pre-printing rollers 10 in an ordinary operational state of the image forming apparatus, as shown in FIG. 1. Reference numeral L2 represents the distance between the nip part 11*a* of the pair of registration rollers 11 and the nip part 10*a* of the pair of pre-printing rollers 10 when the transfer frame 12 is in a pivoting state, as shown in FIG. 2.

With this arrangement, the unfixed toner image on sheet P is prevented from coming into contact with a transfer guide (a guide member) 9, thereby preventing the transfer guide 9 from being stained with toner.

Since the image forming apparatus 30 according to the present embodiment is formed such that the transfer guide 9 is not stained with the unfixed toner image during jam treatment, the sheet P is not stained after the jam treatment, whereby a sheet printed with an image having excellent quality can be obtained even immediately after the jam treatment.

Figure 4:
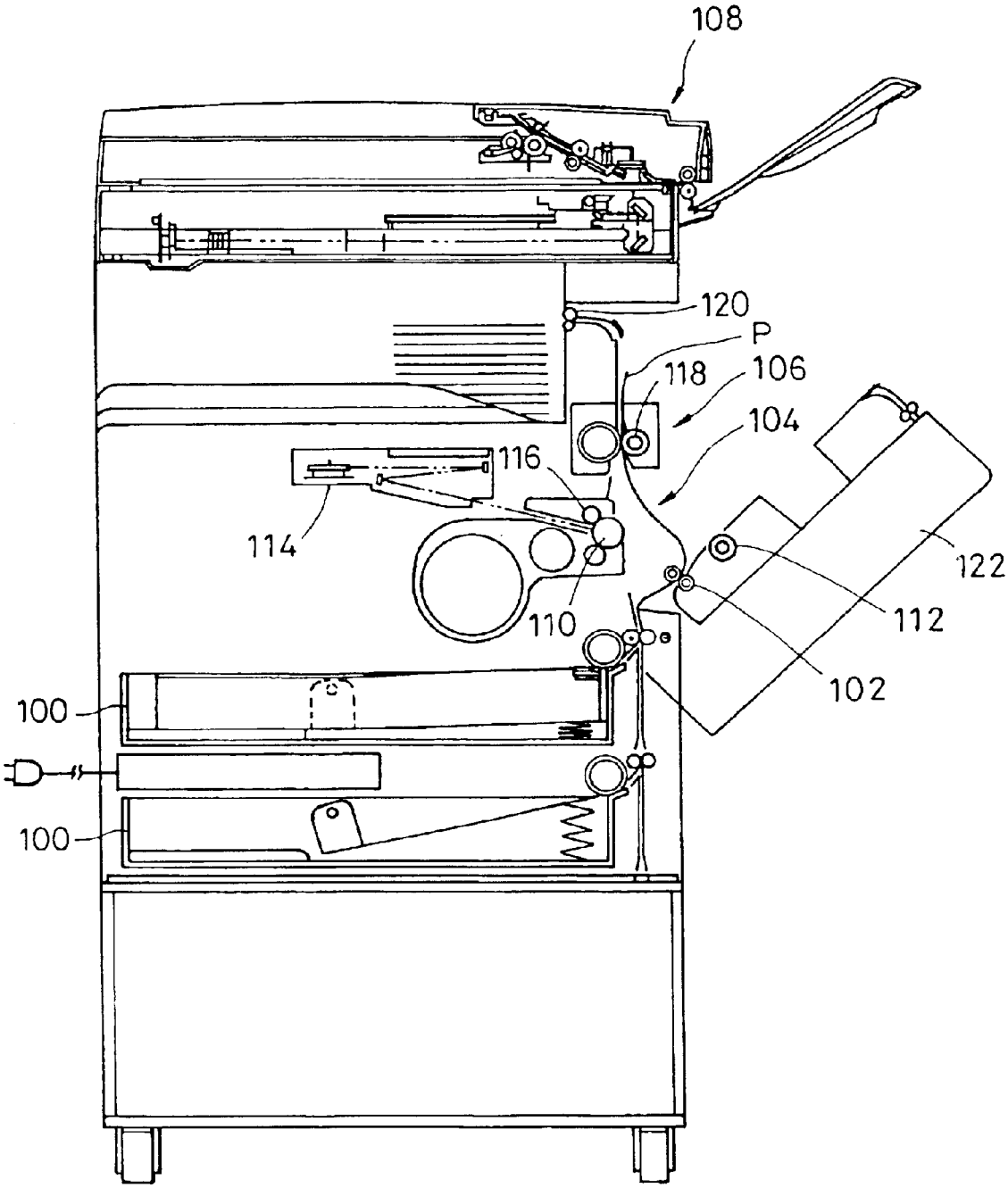
FIG. 4 is an illustration of an image forming apparatus having a vertical transfer path, according to another embodiment of the present invention, in which the image forming apparatus is configured for removal of a jammed sheet.

An image forming apparatus according to another embodiment of the present invention is described below with reference to FIG. 4, in which a vertical sheet-transfer path is provided. FIG. 4 shows the image forming apparatus of which the sheet-transfer path is open so that a jammed sheet is removed.

Cassettes (sheet holders) 100 for holding sheets are provided at the lower part of the image forming apparatus. The sheets fed from the cassettes 100 are sent along the substantially vertical sheet-transfer path and images are formed on the sheets. A pair of registration rollers (a first transfer unit) 102, an image transfer portion 104, and a fixer 106 are disposed in this order along the transfer path. An automatic image-reading device 108 for reading images from an original is disposed at the upper part of the image forming apparatus.

The image transfer portion 104 includes a photosensitive drum 110 and an image transfer roller 112 which is urged to the photosensitive drum 110 at a predetermined pressure. A latent image is formed on the photosensitive drum 110 with a laser beam applied by a laser scanner 114, the latent image being developed to a toner image by a developer 116, and toner of the toner image is transferred to a sheet P by the image transfer roller 112.

The toner image transferred to the sheet P is fixed thereto by a pair of fixing rollers (a second transfer unit) 118 of the fixer 106, and the sheet P is discharged to a discharge space formed between the automatic image-reading device 108 and the image forming device.

A side plate 122 of the image forming apparatus extends along the sheet-transfer path and is pivotable on a pivoting point which is positioned upstream of the sheet-transfer path (at the lower part of the image forming apparatus in the drawing). The side plate 122 is provided thereon with the pair of registration rollers 102 and the image transfer roller 112. When the side plate 122 is closed, the image transfer roller 112 is urged by a spring (not shown) toward the photosensitive drum 110. With this arrangement, when the sheet P is jammed in the sheet-transfer path, the sheet P which stops in the middle of the sheet-transfer path can be removed with the side plate 122 being open.

A jam-detecting sensor (not shown) for detecting a sheet jam is provided in the sheet-transfer path. The jam-detecting sensor is provided with a controller (not shown) for driving the pair of registration rollers 102 by a predetermined amount of rotation when the sheet jam is detected by the jam-detecting sensor.

When the jam-detecting sensor detects the sheet jam, the rotation of the pair of registration rollers 102, the photosensitive drum 110, and the pair of fixing rollers 118 is suspended, whereby the sheet P stops in an intermediate part of the sheet-transfer path. In this case, the sheet P which spans the pair of fixing rollers 118 and the pair of registration rollers 102 is slackened by the controller driving the pair of registration rollers 102 by a predetermined amount of rotation. The sheet P can be reliably slackened by the pair of registration rollers 102 which rotates so as to move the trailing end of the sheet P by a distance larger than the difference of the distance from the pair of registration rollers 102 to the pair of fixing rollers 118 when the side plate 122 is closed and the distance from the pair of registration rollers 102 to the pair of fixing rollers 118 when the side plate 122 is open.

By thus rotating the pair of registration rollers 102 when a sheet jam occurs, the sheet P can be prevented from being damaged from being pulled by the pair of fixing rollers 118 and the pair of registration rollers 102, and the sheet jam can be easily handled because the sheet P is slackened.

The present invention is not limited to the embodiments described above. Although, for example, an electrophotographic image forming apparatus is used in the above embodiments, the present invention may be also applied to, for example, an ink-jet printer for forming images by ejecting ink onto a sheet.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

first sheet-transfer means for transferring a sheet;

second sheet-transfer means for transferring in a downstream direction the sheet transferred from said first sheet-transfer means;

sheet-detecting means for detecting an abnormal transfer state of a sheet in the image forming apparatus;

a pivotable member for supporting at least one of said first sheet-transfer means and said second sheet-transfer means; and control means for controlling driving at least one of said first sheet-transfer means and said second sheet-transfer means in accordance with the detection of an abnormal transfer state by said sheet-detecting means to move the sheet by a predetermined amount so as to form a loop in the sheet between said first sheet-transfer means and said second sheet-transfer means.

2. An image forming apparatus according to claim 1, wherein said pivotable member extends along a sheet-transfer path and is pivotable on a fulcrum disposed upstream of the sheet-transfer path, said pivotable member being provided with said second sheet-transfer means thereon such that a distance between said first sheet-transfer means and said second sheet-transfer means increases and the sheet-transfer path formed between said first sheet-transfer means and said second sheet-transfer means opens when said pivotable member pivots.

3. An image forming apparatus according to claim 1, wherein said control means forms the loop in the sheet by controlling driving of said first sheet-transfer means to feed the sheet toward said second sheet-transfer means.

4. An image forming apparatus comprising:

first sheet-transfer means for transferring a sheet;

second sheet-transfer means for transferring in a downstream direction the sheet transferred from said first sheet-transfer means;

image forming means for forming an image on the sheet transferred by said second sheet-transfer means;

guide means for guiding the sheet as the sheet is transferred from said second sheet-transfer means to the image forming means;

abnormal-transfer-state-detecting means for detecting an abnormal transfer state of a sheet in the image forming apparatus;

sheet-detecting means disposed in the vicinity of the image forming means, for detecting the sheet guided by said guide means;

a pivotable member provided with said second sheet-transfer means and said guide means, extending along a sheet-transfer path and being pivotable on a fulcrum disposed upstream of the sheet-transfer path; and control means for controlling driving said first sheet-transfer means in accordance with the detection of an abnormal transfer state by said abnormal-transfer-state-detecting means, whereby said first sheet-transfer means moves the sheet in a downstream direction by a predetermined amount of movement to form a loop in the sheet between said first sheet-transfer means and said second sheet-transfer means.

5. An image forming apparatus according to claim 4, wherein said second sheet-transfer means is positioned such that a distance between said first sheet-transfer means and said second sheet-transfer means increases when said pivotable member is separated from said image forming means, and the predetermined amount of movement of the sheet by said first sheet-transfer means is greater than an increasing amount of the distance between said first sheet-transfer means and said second sheet-transfer means when said pivotable member is separated from said image forming means.

6. An image forming apparatus according to claim 4, wherein said abnormal-transfer-state-detecting means is disposed between said second sheet-transfer means and said image forming means, and said control means controls driving of said first sheet-transfer means in accordance with the detection by said abnormal-transfer-state-detecting means.

7. An image forming apparatus comprising:

a first sheet transfer unit;

a second sheet transfer unit positioned downstream of said first sheet transfer unit in a sheet conveying direction;

a sheet detector for detecting an abnormal transfer state of a sheet;

a pivotable member positioned to support at least one of said first sheet transfer unit and said second sheet transfer unit;

a controller for controlling the drive of at least one of said first sheet transfer unit and said second sheet transfer unit in accordance with the detection of an abnormal transfer state by said sheet detector to move the sheet by a predetermined amount so as to form a loop in the sheet between said first transfer unit and said second sheet transfer unit; and an image forming device.

8. An image forming apparatus according to claim 7, wherein said pivotable member extends along a sheet transfer path and is pivotable on a fulcrum disposed upstream of the sheet transfer path.

9. An image forming apparatus according to claim 7, wherein said controller forms the loop in the sheet by controlling driving of said first sheet transfer unit to feed the sheet a predetermined distance toward said second sheet transfer unit.

10. An image forming apparatus comprising:

a first sheet transfer unit;

a second sheet transfer unit positioned downstream of said first sheet transfer unit in a sheet conveying direction;

an image forming unit positioned downstream of said second sheet transfer unit in a sheet conveying direction;

a guide positioned to guide the sheet as it is transferred from said second sheet transfer unit to said image forming unit;

an abnormal transfer state detector for detecting an abnormal transfer state of the sheet in the image forming apparatus;

a sheet detector disposed in the vicinity of said image forming unit, for detecting the sheet;

a pivotable member provided with said second sheet transfer unit and said guide, extending along a sheet transfer path and being pivotable on a fulcrum disposed upstream of the sheet transfer path; and a controller for controlling the drive of said first sheet transfer unit in accordance with the detection of an abnormal transfer state by said abnormal transfer state detecting unit, whereby said first sheet transfer unit moves the sheet in a downstream direction by a predetermined amount of movement to form a loop in the sheet between said first sheet-transfer unit and said second sheet-transfer unit.

* * * * *